US009049507B2

(12) United States Patent
Au et al.

(10) Patent No.: US 9,049,507 B2
(45) Date of Patent: Jun. 2, 2015

(54) EFFICIENT ELECTRONICS MODULE

(71) Applicants: Ming Ki Gordon Au, Hong Kong (CN); Kwok Leung Ng, Hong Kong (CN)

(72) Inventors: Ming Ki Gordon Au, Hong Kong (CN); Kwok Leung Ng, Hong Kong (CN)

(73) Assignee: The Marketing Store Worldwide, LP, Chicago, IL (US)

( * ) Notice: Subject to any disclaimer, the term of this patent is extended or adjusted under 35 U.S.C. 154(b) by 164 days.

(21) Appl. No.: 13/573,763

(22) Filed: Oct. 3, 2012

(65) Prior Publication Data

US 2013/0114227 A1 May 9, 2013

Related U.S. Application Data

(60) Provisional application No. 61/542,499, filed on Oct. 3, 2011.

(51) Int. Cl.
*H04R 1/28* (2006.01)
*H04R 1/02* (2006.01)

(52) U.S. Cl.
CPC ..... *H04R 1/028* (2013.01); *H04R 2201/028* (2013.01)

(58) Field of Classification Search
CPC ..... H04R 1/028; H04R 2201/028
USPC ..... 361/760, 764, 783, 717, 719, 720, 807, 361/820, 679.01; 174/250–260
See application file for complete search history.

(56) References Cited

U.S. PATENT DOCUMENTS

| | | | | |
|---|---|---|---|---|
| 6,290,566 | B1 * | 9/2001 | Gabai et al. | 446/175 |
| 6,796,873 | B1 * | 9/2004 | Tsao | 446/436 |
| 7,901,265 | B1 * | 3/2011 | Cameron et al. | 446/330 |
| 2003/0124951 | A1 * | 7/2003 | Ichikawa | 446/330 |
| 2005/0005873 | A1 * | 1/2005 | Gick | 119/707 |

* cited by examiner

*Primary Examiner* — Jenny L Wagner
*Assistant Examiner* — Ahmad D Barnes
(74) *Attorney, Agent, or Firm* — William J. McNichol, Jr.; Reed Smith LLP

(57) ABSTRACT

An efficient electronics package comprising an integrated circuit, a transistor case packaging, a power supply, an actuation segment and a sensor segment, wherein engagement of the integrated circuit causes the actuation segment to be activated. The integrated circuit may be engaged, for example, by a level-hold trigger or the sensor segment.

11 Claims, 2 Drawing Sheets

EFFICIENT ELECTRONICS MODULE

RELATED APPLICATION DATA

This application claims priority to U.S. Provisional Patent Application No. 61/542,499, filed Oct. 3, 2011, which is hereby incorporated by reference in its entirety. This application further incorporates by reference in their entirety the disclosure of U.S. Non-provisional patent application Ser. No. 13/236,086, filed Sep. 19, 2011, "Non-Contact Liquid Sensing Device" and U.S. Non-provisional patent application Ser. No. 13/417,948, filed Mar. 12, 2012, "Toys Implementing Inductively Coupled Power Transfer Systems."

DETAILED DESCRIPTION

Figure 1A:
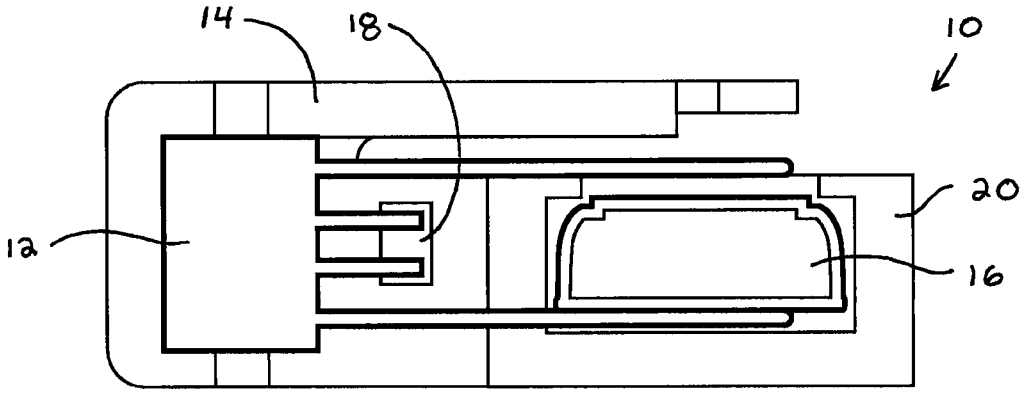
FIG. 1A, FIG. 1B, FIG. 1C are drawings of an exemplary electronics package.

Various embodiments of the present invention will be described in detail with reference to the drawings. Reference to various embodiments does not limit the scope of the invention, which is limited only by scope of claims attached hereto. Additionally, any examples set forth in this specification are not intended to be limiting and merely set forth some of the many possible embodiments. Also, it is to be understood that the phraseology and terminology used herein is for the purpose of description and should not be regarded as limiting. The use of "including", "comprising", or "having" and variations thereof herein is meant to encompass the items listed thereafter and equivalents thereof as well as additional items.

There is a need in the art for an economical to manufacture electronics module. In the prior art, electronics modules require several components, including (at least) a printed circuit board (PCB), a battery contact plate and an on/off switch. Assembly of such electronics module in the prior art typically requires skilled labor or automated machines. As appreciated by those skilled in the art of the disclosed invention, the inefficiencies in the prior art result in significant labor and related costs. For example, the bonding process for an integrated circuit is typically completed by contract manufacturing companies that provide a production line for consumer and other product manufacturing, and such production lines are often costly. Further the prior art requires incorporation of many electronics, including external resistors. All of these additional components increase the cost (e.g. raw materials and labor) and the physical footprint of the sound module.

The invention disclosed herein may be integrated into any application in which an actuation segment is desirable. For example, a speaker may be provided through which a play single or multi-track sound track segment can be made audible. Several advantages over the prior art are provided; for example, a "pick and place" machine (as is commonly used in production lines) is no longer required to mount an integrated circuit onto a PCB. Further, low-skilled or lower skilled technicians may integrate an integrated chip at a reduced cost because technicians need only mount the disclosed invention on a plastic housing, simply insert the required power source (e.g. batteries) and connect an actuation segment. Many different types of actuation segments may be provided; for example, sound via a speaker, lights or motorized movement of an external configuration (e.g. a toy figurine), as well as other actuation segments that are to be appreciated by those skilled in the art.

Further, because the disclosed invention provides a reduced physical footprint over the prior art, the overall dimensions of the electronic package for an electronics module are reduced and, optionally, the disclosed invention may be mounted integral with a battery housing, thereby further reducing the dimensions of the electronic package and also reducing the required assembly parts.

In an embodiment, an integrated circuit or chip 12 is provided that does not require any external components (e.g. resistors). The sound chip may be operatively connected to a standard 4-leads transistor case package 14 (or any other transistor case package as is commonly used by those skilled in the art of the disclosed invention, including, but not limited to TO-94, TO-95 and TO-96, which are 4-lead, 5-lead and 6-lead packages designed by The Marketing Store Worldwide, respectively). The transistor case package 14 incorporating the electronics module 10 may then be affixed directly and operatively to a battery or other power source 16, wherein the transistor package provides leads to the power source and an actuator segment 18. Referring to FIG. 1A, FIG. 1B, FIG. 1C and FIG. 2, activation of the actuator segment 18 may be accomplished by a level-hold trigger, which completes the circuit upon the application of force (directly or indirectly) to the battery 16, the housing 20 of the battery 16, or any other desirable surface as is appreciated by those skilled in the relevant art.

For example, in an embodiment the transistor case package incorporating the electronics module is operatively affixed to a loaded battery compartment and a speaker. The components are all inserted into a toy or other housing. In the case where force is applied to the battery compartment (the direction of the applied force being dependent upon the configuration of the compartment), the electronics module is activated causing the actuator segment to play a sound recording via the speaker. Additional applications of the disclosed embodiment will be clear to persons skilled in the art of the disclosed invention, e.g., toys having limited manufacturing budgets, single sound segment devices, toy figurines that play a single phrase or multiple tracks in sequence, toy guns with sound, animal figures with sound, toy cars with sound, toy phones with sound, light displays, actuation of figurines by way of a mini solenoid (or motor or other structures known in the art), vibration of figurines or a surface, etc.

In a further embodiment, the electronics incorporates inputs for a sensor segment, i.e., an external sensor device. The sensor segment may be coupled with any sensor suitable for detecting environmental changes, including, but not limited to, capacitance sensing plates, optical sensors, vibration sensors, other motion sensors, mechanical buttons, etc. In an embodiment, the sensor segment may be the exclusive means of engaging the actuation segment. In alternative embodiments, the sensor segment may be used in parallel with the above-discussed level-hold trigger in order to cause the actuation segment to be engaged, or no level-hold trigger is used. Alternatively, there may be more than one actuation segment, wherein each is controlled by one or more sensor segments and level-hold segments, respectively or collectively.

In yet a further embodiment, the electronics module stores one or more sound tracks. The sound tracks may be played in consecutive sequence or in random sequence, as configured, upon activation of the sound chip.

Figure 1B:
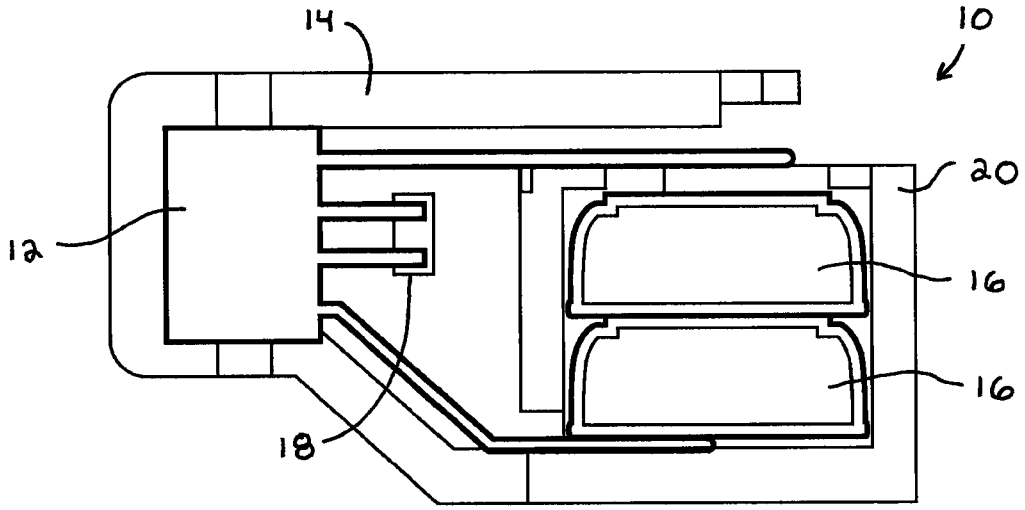
Figure 1C:
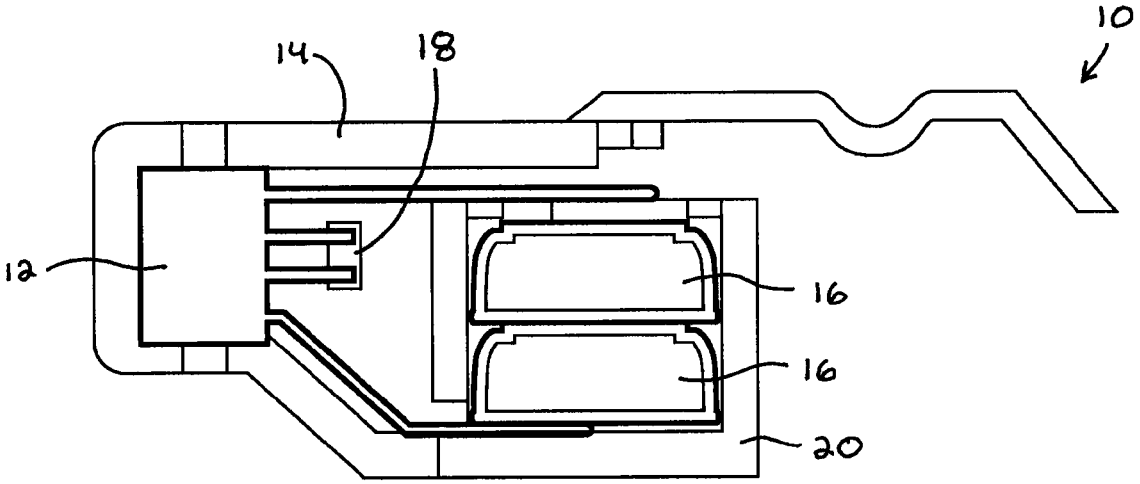

Referring to FIGS. 1A, 1B, and 1C, three exemplary configurations are disclosed; each comprising an electronics module 10 coupled to a transistor case package 14, a power supply 16, a housing 20 for the power supply 16, wherein the transistor case package 14 provides leads from the electronics module 10 to both the actuator segment 18 and the power 16 supply. Various configurations for activating the electronics module are disclosed.

Figure 2:
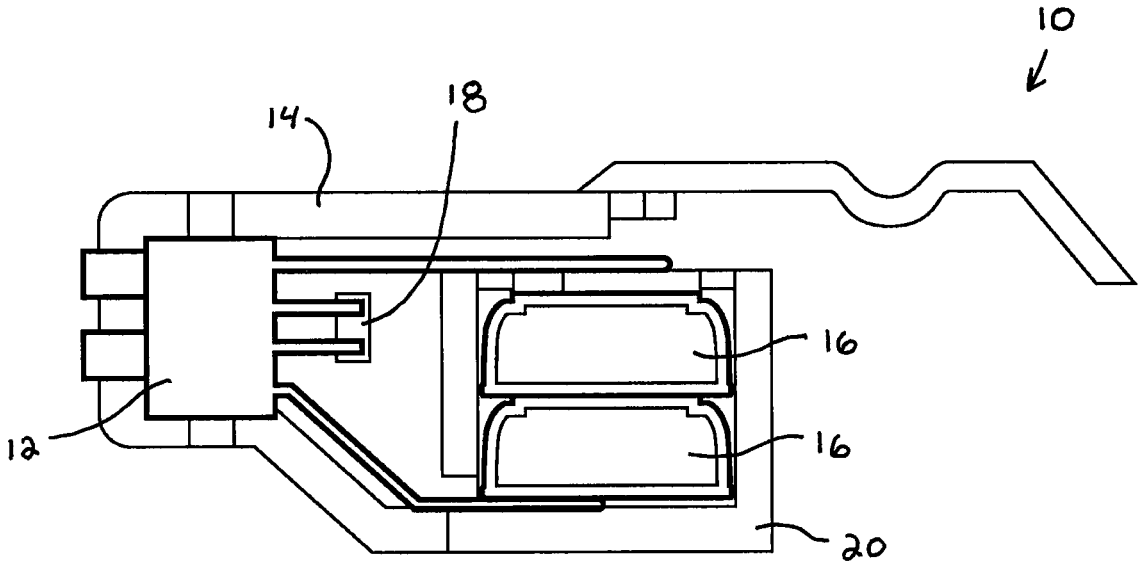
FIG. 2 is a drawing of an exemplary electronics package.

Referring to FIG. 2, an exemplary configuration is disclosed, comprising an electronics module 10 coupled to a transistor case package 14, a power supply 16, a housing 20 for the power supply 16, wherein the transistor case package 14 provides leads from the electronics module 10 to the actuator segment 18, the power supply 18 and the sensor segment.

What is claimed is:

1. An electronics package, consisting essentially of:

an integrated circuit, a housing for the integrated circuit, without additional electronic components, providing leads between the integrated circuit and (i) an actuation segment and (ii) a power supply, wherein application of power to the integrated circuit causes the integrated circuit to activate the actuation segment.

2. The electronics package of claim 1, wherein the integrated circuit is configured to play a recorded sound track, and the actuation segment comprises a speaker.

3. The electronics package of claim 1, wherein the integrated circuit is configured to enable a motor, and the actuation segment comprises a motor.

4. The electronics package of claim 1, wherein the integrated circuit is configured to enable a motor, and the actuation segment comprises a solenoid.

5. The electronics package of claim 1, wherein the integrated circuit is configured to enable one or more lights, and the actuation segment comprises one or more lights.

6. The electronics package of claim 1, wherein the electronics package further comprises a sensor segment.

7. The electronics package of claim 6, wherein the sensor segment comprises an optical sensor.

8. The electronics package of claim 6, wherein the sensor segment comprises a vibration sensor.

9. The electronics package of claim 6, wherein the sensor segment comprises a capacitance sensor.

10. The electronics package of claim 6, wherein the sensor segment comprises a motion sensor.

11. The electronics package of claim 6, wherein the sensor segment comprises a mechanical button.

* * * * *